US005127863A

United States Patent [19]

Goorhuis

[11] Patent Number: 5,127,863

[45] Date of Patent: Jul. 7, 1992

[54] METHOD OF MANUFACTURING A CATHODE RAY TUBE

[75] Inventor: Ger-Wim J. Goorhuis, Eindhoven, Netherlands

[73] Assignee: U.S. Philips Corporation, New York, N.Y.

[21] Appl. No.: 679,975

[22] Filed: Apr. 3, 1991

[30] Foreign Application Priority Data

Apr. 18, 1990 [NL] Netherlands ..... 9000913

[51] Int. Cl.[5] ..... H01J 9/44; H01J 9/12

[52] U.S. Cl. ..... 445/5; 445/6; 445/36

[58] Field of Search ..... 445/5, 6, 62, 22, 36

[56] References Cited

U.S. PATENT DOCUMENTS 3,966,287 6/1976 Liller ..... 445/6
4,326,762 4/1982 Hockenbrock et al. ..... 445/5
4,457,731 7/1984 Patrickson et al. ..... 445/5
4,945,283 7/1990 van Der Heijden et al. ..... 313/451

FOREIGN PATENT DOCUMENTS 0233379 8/1987 European Pat. Off. ..... 445/36
56-168323 12/1981 Japan ..... 445/6

*Primary Examiner*—Kurt Rowan
*Assistant Examiner*—Jeffrey T. Knapp
*Attorney, Agent, or Firm*—Robert J. Kraus

[57] ABSTRACT

A method of manufacturing a cathode ray tube which includes an electron gun (3) having a number of electrodes (7, 8) and a resistive-layer lends system (5), characterized in that the electron gun is sparked in a manufacturing step in which a pulse voltage is applied to an electrode (8) and a direct voltage is applied to a part (9) of the resistive-layer lens system adjacent to said electrode (8) through supply leads. During the sparking step measures are taken to prevent the occurrence of sparks in the resistive-layer lens system (5) per se, which in turn prevents damage to the resistive-layer lens system.

7 Claims, 2 Drawing Sheets

METHOD OF MANUFACTURING A CATHODE RAY TUBE

BACKGROUND OF THE INVENTION

This invention relates to a method of manufacturing a cathode ray tube comprising a display screen and an electron gun including a cathode, a number of electrodes and a resistive-layer lens system.

A cathode ray tube comprising an electron gun including a cathode, a number of electrodes and a resistive-layer lens system is described in, inter alia, European Patent Application 327149, which corresponds to U.S. Pat. No. 4,945,283 (Jul. 31, 1990).

A resistive-layer lens system contains at least one resistive-layer lens. A resistive-layer lens is an electron-optical element in the electron gun, which element comprises a resistive layer, an electron-optical lens for an electron beam being formed, in operation, by applying a voltage or voltages across the resistive layer. The element may comprise a tubular portion. Said tubular portion is provided with a resistive layer or resistive layers, for example, on the inside, across which resistive layer or resistive layers a potential difference or potential differences can be applied. The resistive layer may be spiral-shaped.

An electron gun comprising a resistive-layer lens system is suitable, for example, for use in a colour cathode ray tube or monochrome cathode ray tube, for example, a projection ray tube.

The shape of the spot, i.e. the target spot on the display screen, of an electron beam generated by the electron gun can be forecast within certain limits by means of electron-optical calculations.

It has been found, however, that during operation of a cathode ray tube having such an electron gun, the spot of an electron beam generated by the electron gun is frequently of an inferior quality to that which was expected on the basis of the electron-optical calculations.

SUMMARY OF THE INVENTION

One of the objects of the invention is to improve the quality of the spot.

For this purpose, in a manufacturing step of the method according to the invention, sparks are generated between an electrode and a part of the resistive-layer lens system adjacent to said electrode, a pulse voltage being applied to said electrode and a direct voltage being applied to said adjacent part through supply leads, while measures are taken to counteract the occurrence of sparks in the resistive-layer lens system per se.

The invention is based, inter alia, on the insight that the above problem originates from a step in the method of manufacturing a cathode ray tube, the so-called sparking, as will be explained hereinbelow.

The electron gun is sparked because small irregularities may lead to the emission of electrons or flashover during operation. During sparking, a pulse voltage is applied to said electrode. Sparking, i.e. applying rapidly varying voltages (pulse voltages) between said electrode and said adjacent part of the resistive-layer lens system, permits the induction of flashovers (sparks), so that irregularities on the surface of the electrode and/or said adjacent part of the resistive-layer lens system are removed and the quality of the cathode ray tube is improved. This is important, in particular, when, during operation, a high electric field strength occurs between said electrode and the adjacent part. Experiments carried out within the framework of the invention have shown that sparking an electron gun may adversely affect the electron-optical properties of said electron gun. It is presumed that as a result of the relatively high resistance and high capacitance of the resistive-layer lens system, very high field strengths occur in the resistive-layer lens system when a pulse voltage is applied to said resistive-layer lens system. Owing to the high field strength, sparks are induced in the resistive-layer lens system per se which cause damage to the resistive-layer lens system and adversely affect the electron-optical properties of said resistive-layer lens system.

This is prevented by the method according to the invention.

Measures enabling the occurrence of sparks in the resistive-layer lens system to be precluded in a simple manner consist of the application of a direct voltage to each resistive layer of the resistive-layer lens system.

When a direct voltage is applied to each resistive layer, no high field strengths can occur in the resistive-layer lens system.

Within the scope of the invention, direct voltage is to be understood to include a voltage whose frequency is much lower than the frequency of the pulse voltage and also a voltage which is equal to ground potential. An equal voltage or a constant voltage difference can be applied to both sides of a resistive layer.

The occurrence of sparks in the resistive layer can also be prevented by, for example, arranging elements having a frequency-dependent impedance in the voltage-supply leads, the frequency-dependence being such that pulse voltages which might damage a resistive layer are not supplied to said resistive layer.

Preferably, the method according to the invention is characterized in that the difference between the direct voltage and the pulse voltage is selected such that during sparking no flashover occurs between the supply leads of the electron gun.

The flashover of sparks between the supply leads may cause damage to the supply leads. This also causes fewer or less powerful sparks to flash-over between the said electrode and the adjacent part. This adversely affects sparking.

In an embodiment, the resistive-layer lens system comprises a lens system of the unipotential type and a positive voltage of several tens of kV is applied to both ends of said unipotential lens system, a voltage of approximately 0 kV is applied to a centre electrode of the unipotential lens system and a negative pulse voltage of several tens of kV is applied to an electrode adjacent to said unipotential lens system.

BRIEF DESCRIPTION OF THE DRAWING

By way of example, the invention will be explained in more detail by means of the accompanying drawing, in which.

DETAILED DESCRIPTION OF THE PREFERRED EMBODIMENTS

Figure 1A:
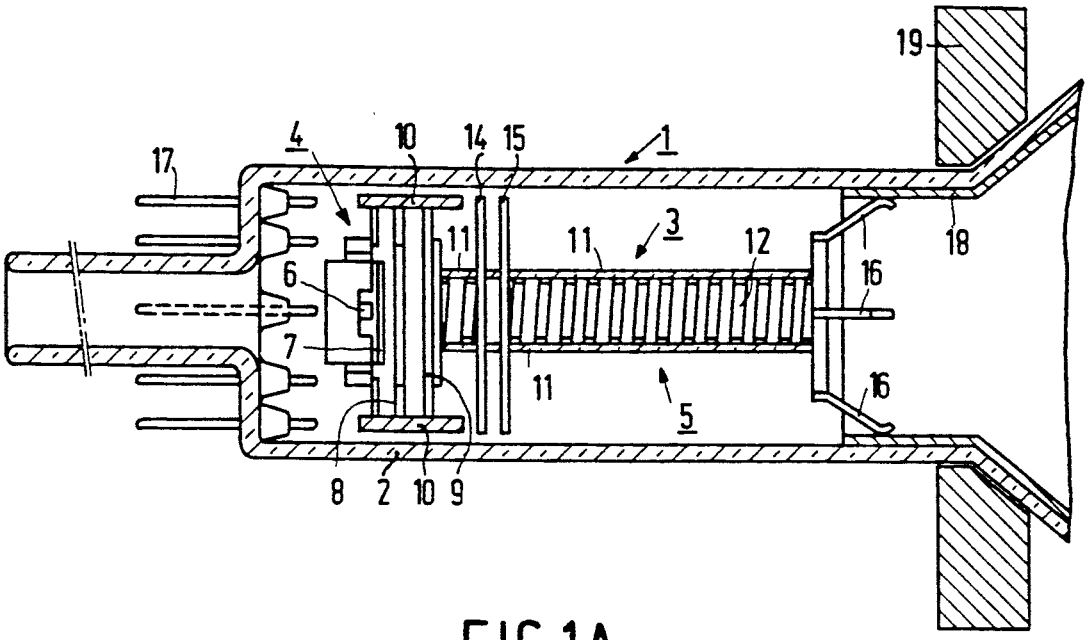
FIGS. 1*a*, 1*b* and 1*c* are detailed sectional views of a cathode ray tube comprising an electron gun having a number of electrodes and a resistive-layer lens system.

The drawings are purely diagrammatical and are not drawn to scale, with corresponding parts generally bearing the same reference numerals.

Figure 1B:
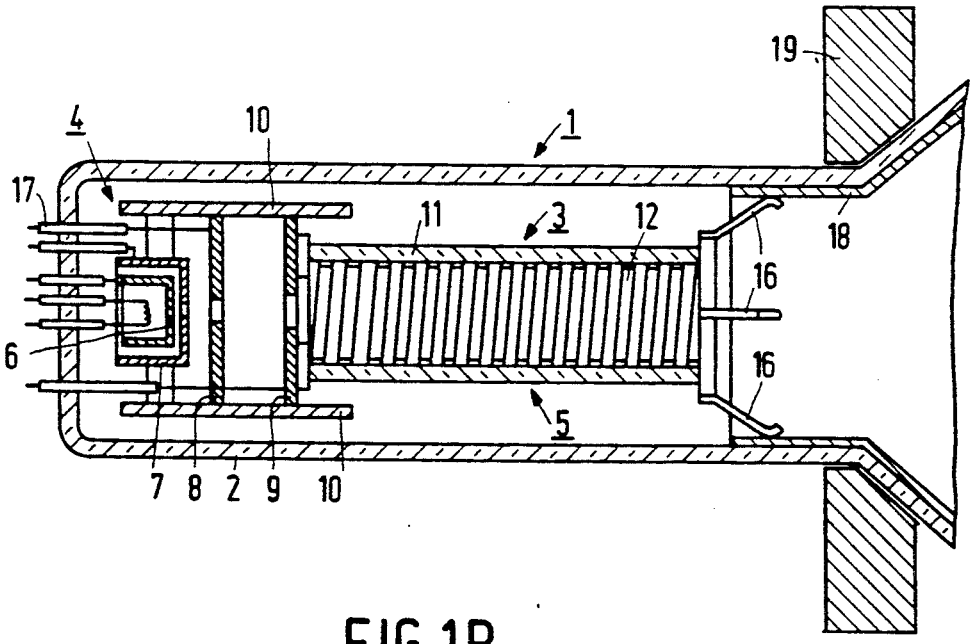
Figure 1C:
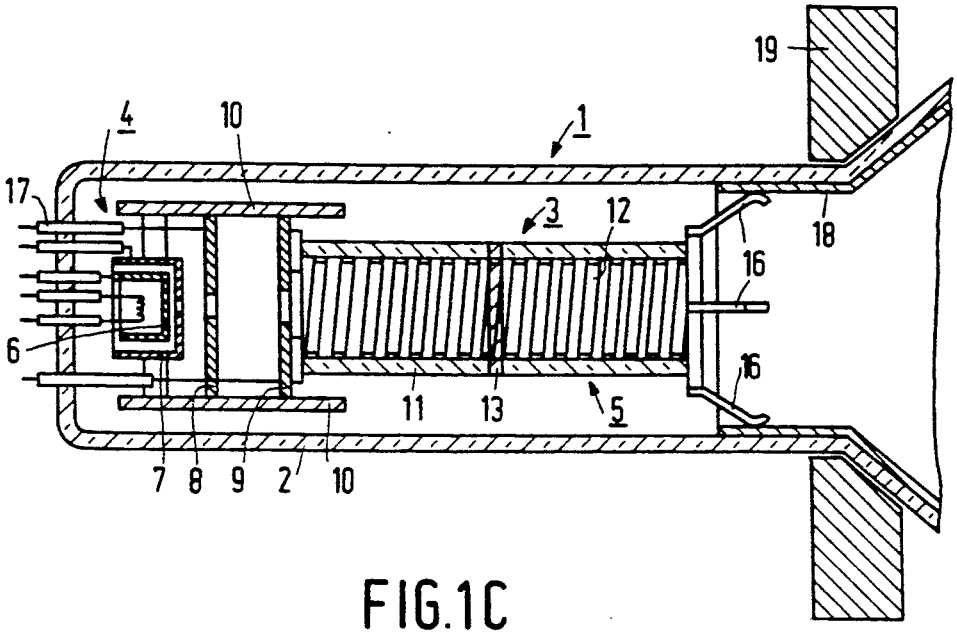

FIGS. 1*a*, 1*b* and 1*c* are detailed sectional views of a cathode ray tube 1 in the neck 2 of which there is provided an electron gun 3 having a system of electrodes 4, a resistive-layer lens system 5 and a cathode 6. In this example, the system of electrodes 4 comprises electrodes 7 and 8 which are mechanically interconnected by electrically insulating connecting rods 10 of, for example, glass. The resistive-layer lens system 5 comprises one or more tubular elements 11 whose inside is provided with a resistive layer 12 having a relatively high resistance. The resistive-layer lens system 5 shown in FIG. 1*a* comprises two portions and electrodes 14 and 15. The first portion forms a pre-focusing lens, the second portion forms a main lens. The resistive-layer lens system 5 shown in FIG. 1*b* forms a bipotential lens. The resistive-layer lens system 5 shown in FIG. 1*c* comprises a conducting ring 13 provided on the inside of the tubular element 11 and forms a unipotential lens. In the present examples, the end of the resistive-layer lens system facing away from the cathode is positioned in the neck 2 of the cathode ray tube 1 by means of an end portion 16 having springs. Said springs electrically contact the conducting layer 18. In this example, the electrode 9 is electrically connected to resistive layer 12 and forms part of the resistive-layer lens system which is adjacent to electrode 8. Within the scope of the invention, at least the resistive layer or resistive layers and the portions of the electron gun which are electrically connected to at least one resistive layer, for example end portion 16 or electrode 9 or a conducting ring at the end of the tubular element 11, etc., are regarded as parts of the resistive-layer lens system. The neck 2 comprises leadthroughs 17 for supplying voltages to parts of the electron gun. The electron beam(s) generated by the electron gun is (are) deflected across a display screen, not shown, by means of a deflection coil system 19.

It has been found that during operation of a cathode ray tube having such an electron gun, the spot, i.e. the target spot on the display screen, of an electron beam generated by said electron gun is often of an inferior quality to that which was expected on the basis of electron-optical calculations.

The invention is based, inter alia, on the insight that the above problem originates at least partly in a specific step in the method of manufacturing a cathode ray tube, namely in sparking.

During operation, small irregularities on the surface of an electrode of the electrode assembly may give rise to emission of electrons or flashover. This has a negative effect on the quality of the cathode ray tube.

Sparking, i.e. applying rapidly varying voltages (pulse voltages) between parts of the electron gun, permits the induction of flashovers (sparks), so that irregularities on the surface of said parts are removed and the quality of the cathode ray tube is improved.

It has been found, that during sparking the resistive-layer lens system may be damaged.

It is presumed, that as a result of the relatively high resistance and high capacitance of the resistive-layer lens system, very high field strengths occur in the resistive-layer lens system when a pulse voltage is applied across the resistive-layer lens system, which high field strengths induce sparks into the resistive-layer lens system, which cause damage to said resistive-layer lens system.

Said damage to the resistive-layer lens system is prevented by the method according to the invention by, for example, applying only (a) direct voltage(s) across the resistive-layer lens system during sparking.

Figure 2:
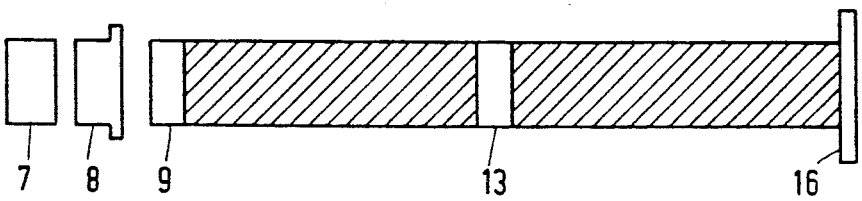
FIG. 2 diagrammatically shows several important parts of the electron gun shown in FIG. 1*c*.

FIG. 2 diagrammatically shows several important parts of the electron gun shown in FIG. 1*c*.

If a pulse voltage occurs in the resistive-layer lens system, sparks may flash-over between conducting parts of said resistive-layer lens system (for example between electrode 9, conducting ring 13 or end member 16) and the high-impedance layer 12. Said sparks damage the high-impedance layer 12 and reduce the quality of the electron gun.

In the embodiment as diagrammatically shown in FIG. 2, the resistive-layer lens system comprises a lens system of the unipotential type. During operation, a voltage of approximately 30 kV is applied to both ends (electrodes 9 and 16) of the resistive-layer lens system, a voltage of approximately 5.5 kV is applied to the centre electrode (electrode 13) of the resistive-layer lens system and a voltage of approximately 0.5 kV is applied to an electrode (electrode 8) of the electrode system, which electrode is adjacent to the resistive-layer lens system. During sparking, a voltage of several tens of kV, for example between 25 kV and 45 kV, preferably between 30 and 40 kV, is applied to both ends (electrodes 9 and 16) of the resistive-layer lens system, which voltage, preferably, increases slowly in the course of the sparking process; a voltage of approximately 0 V, for example between −5 kV and 5 kV, preferably ground potential, is applied to the centre electrode (electrode 13) of the resistive-layer lens system, and a negative pulse voltage of several tens of kV, for example a pulse voltage between −20 kV and −30 kV, preferably approximately −25 kV is applied to an electrode (electrode 8) of the electrode system, which electrode is adjacent to the resistive-layer lens system. By virtue thereof, sparks are generated between electrode 8 and a part of the resistive-layer lens system adjacent to electrode 8, in this example electrode 9. During sparking, the resistive-layer lens system remains undamaged, and at said values there is only a small risk of flashover between the supply leads 17 during sparking.

Figure 3:
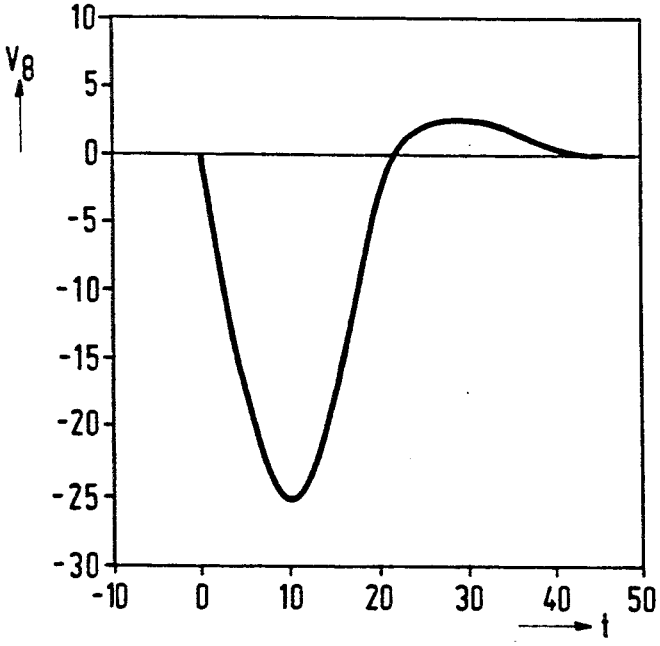
FIG. 3 graphically represents the height of the pulse voltage as a function of time.

Table 1 lists the voltage ($V_9$) applied to the electrodes 9 and 16, the voltage $V_8$ applied to electrode 8 and the voltage $V_{13}$ applied to electrode 13 as a function of time t (in min.). By way of example, FIG. 3 shows an example of the voltage $V_8$ in kV applied to electrode 8 as a function of time t (in μsec).

TABLE 1

| $V_9$ | $V_8$ | $V_{13}$ | t |
|---|---|---|---|
| 30 | −25 | 0 | 1 |
| 35 | −25 | 0 | 1 |
| 40 | −25 | 0 | 4 |

In the foregoing, the invention is illustrated by means of specific examples of electron guns, however, it will be obvious that the method is not limited to said examples. The electron gun shown in FIG. 1*b*, which comprises a resistive-layer lens system of the bipotential type can be sparked, for example, by applying a negative pulse voltage of several tens of kV to electrode 8, and by applying relatively low direct voltages, for example between 0 and 10 kV, to electrodes 9 and 16. The electrode system may comprise more than two electrodes; the resistive-layer lens system may comprise several sub-lens systems; the electron gun may comprise a spiral lens of the bi- and/or unipotential type; the cathode ray tube may be a monochrome cathode ray tube, for example a projection tube or a DGD-(Data Graphic Display) tube or a colour cathode ray tube of the in-line or delta type. Voltages outside the ranges given in the example may be applied to the electrodes or the lens system and the electron beam(s) may be deflected by, for example, a system of deflection plates instead of the deflection coil system 19.

I claim:

1. A method of making a cathode ray tube which includes a display screen and an electron gun including a cathode, a number of electrodes and a resistive-layer lens system, said method comprising: generating sparks between an electrode and a part of the resistive-layer lens system adjacent to said electrode by applying a pulse voltage to said electrode and a direct voltage to said adjacent part via supply leads, and applying a direct voltage across each resistive layer of the resistive-layer lens system in a manner so as to counteract the occurrence of sparks in the resistive-layer lens system.

2. A method as claimed in claim 1 wherein the difference between the direct voltage and the pulse voltage is selected such that during sparking no flashover occurs between the supply leads of the electron gun.

3. A method as claimed in claim 1 wherein the resistive-layer lens system comprises a lens system of the unipotential type, characterized in that a positive voltage of several tens of kV is applied to both ends of said unipotential lens system, a voltage of approximately 0 kV is applied to a centre electrode of the unipotential lens system, and a negative pulse voltage of several tens of kV is applied to an electrode adjacent to said unipotential lens system.

4. A method as claimed in claim 3 wherein the resistive-layer lens system comprises a tubular portion which is provided with a resistive layer.

5. A method as claimed in claim 2, wherein the resistive-layer lens system comprises a lens system of the unipotential type, characterized in that a positive voltage of several tens of kV is applied to both ends of said unipotential lens system, a voltage of approximately 0 kV is applied to a center electrode of the unipotential lens system, and a negative pulse voltage of several tens of kV is applied to an electrode adjacent to said unipotential lens system.

6. A method as claimed in claim 1, which further comprises, during the course of the spark generating process, slowly increasing the value of the direct voltage applied across the resistive layer of the resistive-layer lens system.

7. A method as claimed in claim 1 wherein said pulse voltage is applied to said electrode and to said part of the resistive-layer lens system via said supply leads of the cathode ray tube and a frequency-dependent impedance in a manner that inhibits the supply of the pulse voltage to the resistive layer.

* * * * *